US011131092B2

(12) United States Patent
Johnson

(10) Patent No.: US 11,131,092 B2
(45) **Date of Patent: *Sep. 28, 2021**

(54) LATH AND DRAINAGE

(71) Applicant: INNOVATION CALUMET LLC, Valparaiso, IN (US)

(72) Inventor: Gary R. Johnson, Gary, IN (US)

(73) Assignee: INNOVATION CALUMET LLC, Valparaiso, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/868,741

(22) Filed: May 7, 2020

(65) Prior Publication Data

US 2020/0263420 A1 Aug. 20, 2020

Related U.S. Application Data

(63) Continuation of application No. 16/407,058, filed on May 8, 2019, now Pat. No. 10,689,847, which is a continuation of application No. 15/682,467, filed on Aug. 21, 2017, now Pat. No. 10,294,661, which is a continuation of application No. 15/159,762, filed on May 19, 2016, now Pat. No. 9,739,056, which is a continuation of application No. 14/842,471, filed on Sep. 1, 2015, now Pat. No. 9,366,033, which is a continuation of application No. 13/848,993, filed on Mar. 22, 2013, now Pat. No. 9,127,467.

(60) Provisional application No. 61/614,673, filed on Mar. 23, 2012.

(51) Int. Cl.

| | |
|---|---|
| ***E04F 13/04*** | (2006.01) |
| ***E04B 2/84*** | (2006.01) |
| ***E04F 13/08*** | (2006.01) |
| ***E04B 1/66*** | (2006.01) |
| ***E04B 1/70*** | (2006.01) |

(52) U.S. Cl.

CPC ..... *E04B 2/845* (2013.01); *E04B 1/665* (2013.01); *E04B 1/7038* (2013.01); *E04F 13/04* (2013.01); *E04F 13/047* (2013.01); *E04F 13/08* (2013.01); *Y10T 428/249962* (2015.04)

(58) Field of Classification Search

CPC ..... E04B 2/845; E04B 1/665; E04B 1/7038; E04F 13/04; E04F 13/047; E04F 13/08; Y10T 428/249962

See application file for complete search history.

(56) References Cited

U.S. PATENT DOCUMENTS

| | | | |
|---|---|---|---|
| 1,767,565 | A | 6/1930 | Thrift et al. |
| 2,864,251 | A | 12/1958 | Imbrogno et al. |
| 5,287,673 | A | 2/1994 | Kreikemeier |
| 5,481,843 | A | 1/1996 | Kreikemeier |
| 5,826,388 | A | 10/1998 | Irving |
| RE36,676 | E | 5/2000 | Sourlis |
| 6,131,353 | A | 10/2000 | Egan |
| 6,355,333 | B1 | 3/2002 | Waggoner et al. |
| 6,594,965 | B2 | 7/2003 | Coulton |
| 6,761,006 | B2 | 7/2004 | Lubker, II |

(Continued)

FOREIGN PATENT DOCUMENTS

| | | | |
|---|---|---|---|
| CA | 2559160 | A1 | 3/2007 |
| WO | 2009006441 | A2 | 1/2009 |

*Primary Examiner* — Beth A Stephan

(74) *Attorney, Agent, or Firm* — GrowIP Law Group LLC

(57) ABSTRACT

An improved lath is disclosed having a water drainage layer provided in association with the lath. The water drainage layer serves to remove water that might otherwise build up between the lath and wall structure.

18 Claims, 3 Drawing Sheets

(56) References Cited

U.S. PATENT DOCUMENTS

| | | | |
|---|---|---|---|
| 6,786,013 | B2 | 9/2004 | Coulton |
| 6,869,901 | B2 | 3/2005 | Lubker, II |
| 6,990,775 | B2 | 1/2006 | Koester |
| 7,287,356 | B2 | 10/2007 | Sacks et al. |
| 7,343,716 | B2 | 3/2008 | Nordgren et al. |
| 7,520,097 | B2 | 4/2009 | Aalbers et al. |
| 7,584,581 | B2 | 9/2009 | Iske |
| 7,607,270 | B2 | 10/2009 | Ehrman et al. |
| 7,757,447 | B2 | 7/2010 | Aalbers et al. |
| 7,807,011 | B2 | 10/2010 | Dunstan et al. |
| 7,858,174 | B2 | 12/2010 | Ehrman et al. |
| 7,902,092 | B2 | 3/2011 | Egan et al. |
| 7,908,801 | B2 | 3/2011 | Nielsen et al. |
| 8,298,967 | B2 | 10/2012 | Egan et al. |
| 2002/0108333 | A1 | 8/2002 | Clayton |
| 2004/0074184 | A1 | 4/2004 | Naji |
| 2006/0101758 | A1 | 5/2006 | Egan |
| 2007/0051069 | A1 | 3/2007 | Grimes |
| 2007/0175145 | A1 | 8/2007 | Sacks et al. |
| 2007/0261365 | A1 | 11/2007 | Keene |
| 2009/0031656 | A1 | 2/2009 | Hunt-Hansen et al. |
| 2012/0216481 | A1 | 8/2012 | Hunt-Hansen et al. |
| 2012/0304565 | A1 | 12/2012 | Hines et al. |

LATH AND DRAINAGE

CROSS-REFERENCE TO RELATED APPLICATIONS

The present application is a continuation of U.S. application Ser. No. 16/407,058, filed on May 8, 2019, which is a continuation of U.S. application Ser. No. 15/682,467, filed on Aug. 21, 2017, and that issued as a U.S. Pat. No. 10,294,661 on May 21, 2019, which is a continuation of U.S. application Ser. No. 15/159,762, filed on May 19, 2016, and that issued as U.S. Pat. No. 9,739,056 on Aug. 22, 2017, which is a continuation of U.S. application Ser. No. 14/842,471, filed on Sep. 1, 2015, and that issued as U.S. Pat. No. 9,366,033 on Jun. 14, 2016, which is a continuation of U.S. application Ser. No. 13/848,993, filed on Mar. 22, 2013, and that issued as a U.S. Pat. No. 9,127,467 on Sep. 8, 2015, which claims priority from U.S. Provisional Application No. 61/614,673, filed on Mar. 23, 2012, all of which are incorporated by reference herein in their entirety.

FIELD OF THE INVENTION

This invention generally relates to lath, and more particularly to an integrated drainage system with lath for use in stone, or thin brick, veneer and stucco.

BACKGROUND

The use of hard coat stucco has been employed as a building material since literally ancient days. For stucco and plaster applications, a lath or mesh is typically applied to the surface of the wall or ceiling structure. This provides mechanical holding or keying for the unhardened stucco or plaster. Metal lath is often used as the reinforcement when stucco or plaster is applied over open frame construction, sheathed frame construction, or a solid base having a surface that might otherwise provide an unsatisfactory bond for the stucco or plaster. When applied over frame construction, one may employ base coats of plaster with a total thickness of approximately ⅜ inch to approximately ¾ inch to produce a solid base for a decorative finish coat. Metal lath reinforcement is also recommended for the application of stucco and plaster to old concrete or masonry walls, especially if the surface is lacking in compatibility with the base layer. There are also plastic laths available for the same purpose as metal lath.

According to the International Conference of Building Officials Acceptance Criteria for Cementitious Exterior Wall Coatings, AC 11, effective Oct. 1, 2002, and evaluation report NER-676, issued Jul. 1, 2003, wire fabric lath should be a minimum of No. 20 gauge, 1 inch (25.4 mm) (spacing) galvanized steel woven-wire fabric. The lath should be self-furred, or furred when applied over all substrates except unbacked polystyrene board. Metal lath has structural integrity, but if made of steel can corrode over time. The metal can also unfavorably react with the chemistry of the plaster or stucco. Hence, plastic or non-metal lath has gained popularity.

Stone veneer has also gained in popularity. Mounting of stone veneer using lath can present similar issues to that of plaster and stucco. A concern with the stone veneer, and even stucco, is that moisture can find its way behind the outer stone or stucco surface. This can present itself by way of hole penetrations in putting up the lath, and water condensing or otherwise migrating behind the lath.

SUMMARY

In one aspect of the invention, a matrix of randomly oriented plastic or other durable fibers which are relatively rigid, or which can be treated to be relatively rigid or organized into a matrix that is relatively rigid, is employed as the lath. An example of the foregoing kind of material is sold under the name MORTAR NET, sold by Mortar Net, Inc. of Burns Harbor, Ind., and such as disclosed in U.S. Pat. No. Re. 36,676. Such a matrix lath would preferably be on the order of around except ¼" thick (in front to back width). The matrix lath would preferably be provided in large sheets or rolls having substantial length and height.

In this embodiment, preferably affixed to the matrix lath, as by bonding thereto, is a layer that will form a water channel layer and spacer inboard to the matrix lath. In one form, this water channel layer is of a material similar to that of the foregoing matrix lath, but of a smaller fibrous diameter entangled randomly oriented plastic or other durable fiber, formed in a thinner width, such as 3/16" or ¼" WALLNET product, which is made and sold under that name by. Mortar Net, Inc. from stock material made by the Fiber Bond Corporation. WALLNET is an airlaid, nonwoven media composed of polyester fibers bonded with a blend of PVC polymers and an anti-microbial, with a general weight of about 3.5 oz/yd2. This water channel layer is of similar length and height as that of the matrix lath. While this water channel layer is preferably joined to the matrix lath in some manner, it could be separate in use.

Additionally, although not necessarily, a further layer of material may be provided in the form of a thin scrim that would be between the matrix lath and the water channel face outward from the structure. The scrim layer is much more tightly structured, preferably non-woven, but is water permeable. It is of like length and height as the matrix lath and water channel layer. The scrim adds some further integrity to the construct, it acts as an insect barrier, and provides additional protection against mortar clogging the water channel layer.

In use, the foregoing embodiment of matrix lath and water channel layer, including scrim if desired, is affixed to an inner wall structure, as by nailing or screwing thereto, with the water channel layer most inboard and against the wall structure. Plaster can be applied to the matrix lath in a standard manner of application. The water layer forms a drainage plane that allows water which may have penetrated cracks in the stucco or between the mortar and veneer, to drain out; such water incursion is normal in brick construction that creates the need for a cavity wall construction. Effectively, the water channel layer functions as a cavity filled with mesh. Water is effectively blocked from entering the structure, however, and drains vertically downward through the mesh of the water channel layer, to exit the wall at the bottom, as being drained through weep holes or the like. The water exit at the bottom might be accomplished by having a layer at the bottom of the wall with drainage channels similar to that shown in U.S. Pat. Nos. 7,543,413 and 7,513,414.

In an alternative embodiment, a thin sheet of plastic thermoformed to have features to capture mortar, not unlike metal lath, may be provided for the water channel layer. This could be an open-weave type material that is formed with corrugations or projections extending from what would be the plane of the material.

In a further embodiment, the lath is spaced from the water layer (with or without scrim layer), through the use of spacers, such as soft foamacious elements. The spacers themselves may also act as receptacles for the screws or nails used to put up the lath. In this way, the foam material serves to "seal" the penetrations made in the wall structure. The spacers can also be arranged in a manner to catch debris falling behind the lath, while still allowing water to pass. The spacers could be arranged as blocks spaced laterally from one another, of any desired shape (rectangle, circle, etc.).

In another embodiment, a combination of spacers and scrim is contemplated. In this version, a non-woven scrim material is provided with integral thermoplastic bumps affixed thereto over a surface. The bumps may be a rubber or other somewhat flexible material, for instance, which can serve not only a stand-off function, but also receive a nail or other fixation device through the bump, thus yielding a self-sealing function.

Additionally, a water or vapor barrier can further be provided as the innermost (inboard) layer of the construct.

In an embodiment, the foregoing combination of flexible fibrous or matrix lath, spacers, water channel layer, with or without scrim and/or vapor barrier, can be made unified, and provided as a more or less continuous roll stock material. An installer thus would only need to "cut to size" for the application.

DETAILED DESCRIPTION

Figure 1A:
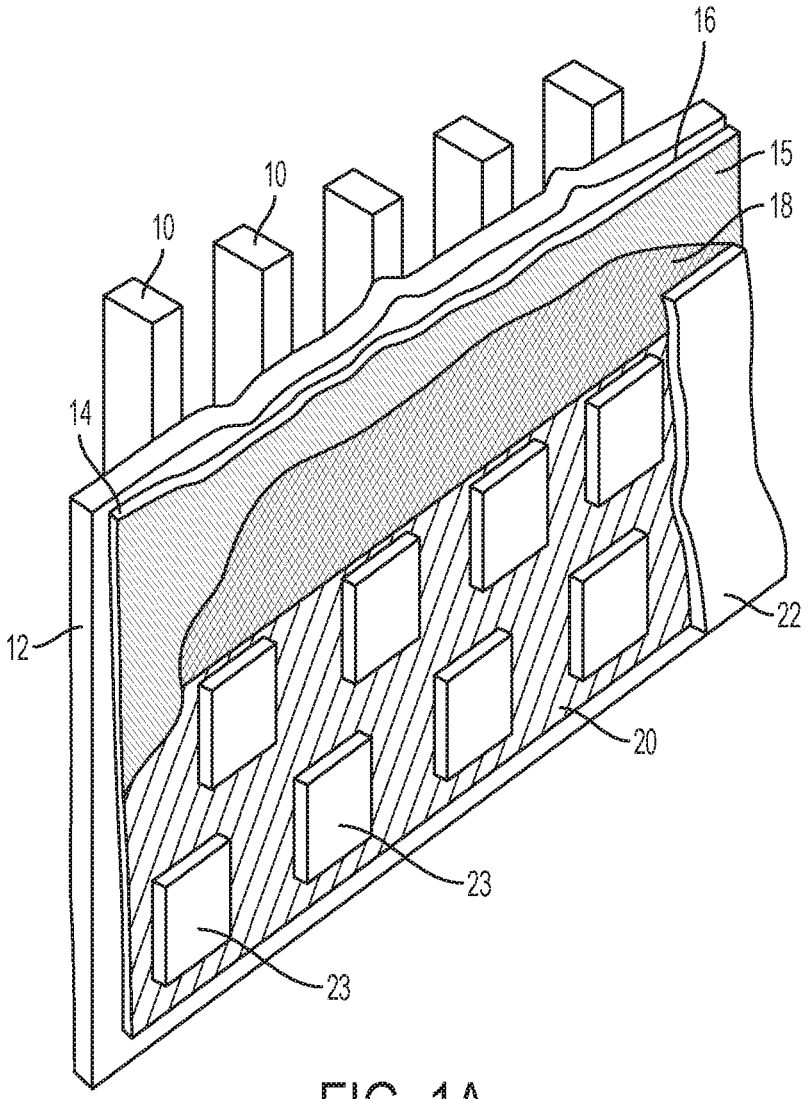
FIG. 1A is a perspective view of a wall structure with a lath and water channeling construct made in accordance with the invention.
Figure 1B:
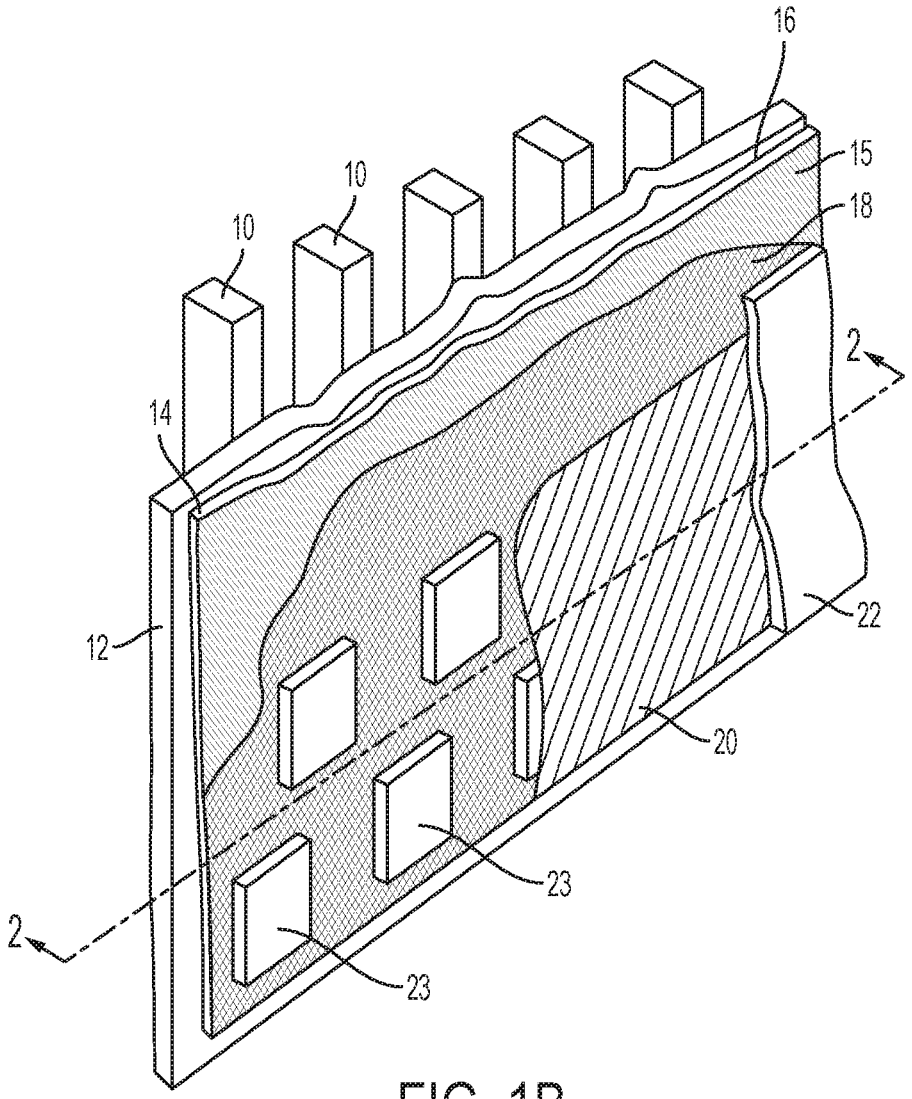
FIG. 1B is another perspective view of a wall structure with a lath and water channeling construct made in accordance with the invention.
Figure 2:
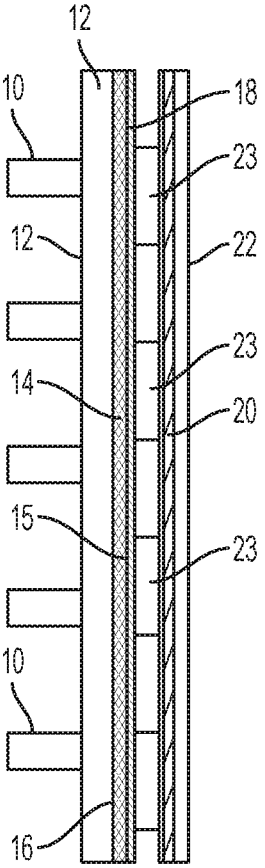
FIG. 2 is a sectional view taken along line 2-2 of FIG. 1B.

Referring now to FIGS. 1B and 2 in particular, a construct in the form of a structural support for plaster, stucco and stone veneer is disclosed. A typical wall is shown, being formed of studs 10 to which a wallboard or wood sheathing 12 is attached in well-known manner.

Outboard of the wallboard 12 (inboard being toward the studs 10), is a water channel material 14. In this embodiment, the water channel material is a fibrous mesh or matrix made up of thin plastic filaments or fibers. Such a material is sold by Mortar Net, Inc. under the name WALLNET. Here, the material is about ¼ inch to about inch thick in width (width being measured normal to the substantially planer front side 15 and backside 16 of the water channel material 14). The water channel material thus generally fills the width defined between front side 15 and backside 16, forming a circuitous pathway for water that may then flow therebetween. The water channel material nonetheless can catch and hold debris that might fall thereon from above, without clogging the water channel thereby provided.

If desired, a vapor barrier layer (not shown) may be provided inboard of the water channel material, against the wallboard. This could be a plastic sheet, or a spray-on vapor barrier.

Next outboard from the water channel material 14 is an optional scrim 18. Scrim 18 is a non-woven sheet material in this embodiment which permits air and water to pass therethrough, but can provide some additional support and serve as a barrier to tiny insects.

A lath material 20 is provided. There are many known types of lath, including metal and plastic being most commonly used. The lath serves as the main supporting structure for receiving and holding plaster or stucco, or some cementitious or other adhesive compound for holding stone veneer 22, for instance.

In this embodiment, spacers 23 are used between the lath 20 and the scrim/water channel material. The spacers 23 may advantageously be glued or otherwise adhered to one or both of the layers on either side thereof. Spacers 23 are made of a soft foam material, which provides a self-sealing barrier for water when nails, screws or the like are driven through the spacers, so as to mount the lath 20 to the wallboard 12.

It will be understood that some of the foregoing elements need not be employed in the exact order shown in FIGS. 1B and 2. The elements may be employed, for example, in the order shown in FIG. 1A.

Note that one of the advantages of the present invention is that the construct of water channel material 14, spacers 23 and lath 20, with or without scrim 18, with or without vapor barrier, can be provided as a unitary whole. Especially advantageous is to make the construct as a roll stock material, so that a builder may simply unroll the amount desired and "cut to size," more or less.

Figure 3:
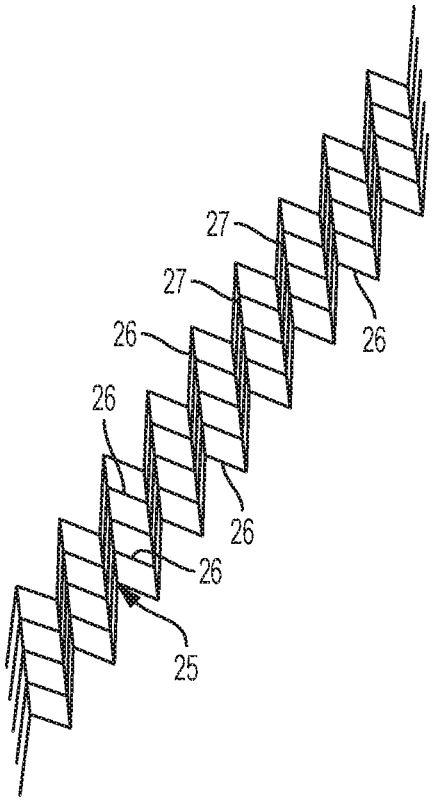
FIG. 3 is a view of a corrugated lath material.

FIG. 3 shows a type of material 25 that could be used as a lath material in this application. Here, it is a filamentous plastic having thin diameter elements 26 that run roughly parallel to one another, which are joined by other elements 27 that cross therebetween. The elements 26, 27 having sufficient rigidity to be formed into a somewhat corrugated surface having peaks and valleys. The material is open, so as to receive plaster, stucco, or other cementitious or adhesive material therein, and thereby serve the function of lath.

Figure 4:
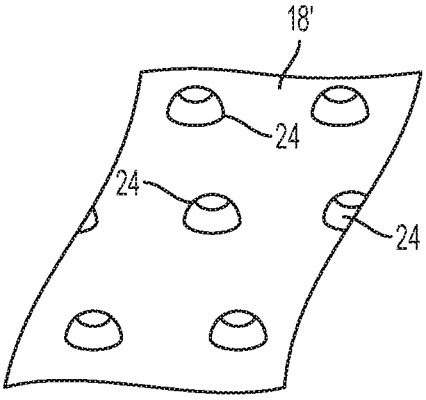
FIG. 4 is a perspective view of a scrim material with stand-off elements.

FIG. 4 shows a variation on the scrim 18, which is here provided with integral stand-off elements or bosses. Scrim 18' is as previously described, being a high loft non-woven thin material. This could also be some other material, whether non-woven or not. Attached to scrim 18' are the bosses or bumps 24, which are affixed to one side of the scrim, as by bonding thereto. These bosses 24 may be made of a material that can readily receive a nail, screw or the like, and thereby attach the scrim in a manner whereby the fastener is self-sealed by the boss through which it passes. A rubber or rubber-like material may be used, or some softer thermoplastic, just to name two examples. The combination of scrim plus stand-off elements may have good advantage in field application.

Thus, while the present invention has been described with respect to a certain embodiment, numerous changes and modifications will be apparent to those of skill in the art, and such changes and modifications are intended to be encompassed within the spirit of the invention, as defined by the claims.

I claim:

1. A construct for use in a wall structure, comprising:

a lath member; and a water channel material having a front side and a back side with a width defined therebetween, the width of the water channel material including therein a structure that yields a path for water passing through the width of the water channel material under the influence of gravity when the water channel material is in use, wherein the water channel material comprises a plastic sheet defining a plane and having a front side and a back side, wherein the water channel material has corrugations, projections or a combination thereof extending from the plane of the water channel material.

2. The construct of claim 1, wherein the corrugations, the projections or the combination thereof define drainage channels from a top to a bottom of the water channel material.

3. The construct of claim 1, wherein the corrugations, the projections or the combination thereof are thermoformed in the water channel material.

4. The construct of claim 1, wherein the corrugations, the projections or the combination thereof extend from the back side of the water channel material.

5. The construct of claim 1, wherein the lath member has a front side and a back side and the back side of the lath member is coupled to the front side of the water channel material such that the lath member and the water channel material form a unitary continuous roll stock material.

6. The construct of claim 1, wherein the plastic sheet of the water channel material is non-fibrous.

7. The construct of claim 1, wherein the lath member comprises a matrix of fibers forming openings in the lath member configured to permit keying for cementitious material.

8. The construct of claim 1, wherein the water channel material and the lath member are joined together as an integrated whole as a continuous roll stock material.

9. The construct of claim 1, wherein the lath member comprises a material configured to receive cementitious matter such that the material of the lath member acts as a structural element for affixing the cementitious matter to the wall structure.

10. The construct of claim 1, wherein the lath member comprises a first plurality of filamentous plastic elements arranged parallel to one another that are joined by a second plurality of filamentous plastic elements that cross therebetween.

11. A construct for use in a wall structure, comprising:

a lath member comprised of a first plurality of filamentous plastic elements arranged parallel to one another that are joined by a second plurality of filamentous plastic elements that cross therebetween thereby forming a matrix, the lath member having a front side and a back side; and a water channel material comprising a sheet of plastic having corrugations, projections or a combination thereof extending from a plane of the water channel material, the water channel material having a front side and a back side, wherein the front side of the water channel material is coupled to the back side of the lath member.

12. The construct of claim 11, wherein the front side of the water channel material is planar.

13. The construct of claim 11, wherein the corrugations, the projections or the combination thereof extend from the back side of the water channel material.

14. The construct of claim 11, wherein the corrugations, the projections or the combination thereof are configured to permit water to drain vertically downward therethrough.

15. The construct of claim 14, wherein the corrugations, the projections or the combination thereof define drainage channels from a top to a bottom of the water channel material.

16. The construct of claim 15, wherein the drainage channels include corrugations alternating with projections.

17. The construct of claim 11, wherein the corrugations, the projections or the combination thereof are thermoformed in the water channel material.

18. The construct of claim 11, wherein the matrix of the lath member has a plurality of openings configured to permit keying for cementitious material.

* * * * *